US006568624B2

(12) United States Patent
Jackson

(10) Patent No.: US 6,568,624 B2
(45) Date of Patent: May 27, 2003

(54) BARBED WIRE HOLDER, CARRIER, AND UNREELER

(76) Inventor: George C. Jackson, 630 Strickland Rd., Byhalia, MS (US) 38611

( * ) Notice: Subject to any disclaimer, the term of this patent is extended or adjusted under 35 U.S.C. 154(b) by 86 days.

(21) Appl. No.: 09/967,547

(22) Filed: Oct. 1, 2001

(65) Prior Publication Data

US 2002/0038837 A1 Apr. 4, 2002

Related U.S. Application Data

(60) Provisional application No. 60/237,485, filed on Oct. 4, 2000.

(51) Int. Cl.[7] ..... B65H 49/32; B65H 75/40

(52) U.S. Cl. ..... 242/588.2; 242/598.2; 242/405.3

(58) Field of Search ..... 242/588.2, 588.1, 242/588, 598.2, 129, 129.6, 129.62, 403.1, 405.3, 406, 401, 557, 139

(56) References Cited

U.S. PATENT DOCUMENTS

| | | | | | |
|---|---|---|---|---|---|
| 157,124 | A | | 11/1874 | Glidden | |
| 201,388 | A | * | 3/1878 | Castle | 242/403.1 |
| 353,340 | A | * | 11/1886 | Wilcox | 242/403.1 |
| 467,499 | A | | 1/1892 | Dulin | |
| 589,490 | A | | 9/1897 | Young | |
| 594,977 | A | | 12/1897 | Williams | |
| 1,249,691 | A | | 12/1917 | Tillman | |
| 1,341,484 | A | | 5/1920 | Starratt | |
| 1,648,568 | A | | 11/1927 | Stoffel | |
| 2,029,953 | A | | 2/1936 | Sutilef | |
| 2,067,765 | A | | 1/1937 | Juranic | |
| 2,089,335 | A | | 8/1937 | Brown | |
| 2,140,676 | A | | 12/1938 | Hohner | |
| 2,488,425 | A | * | 11/1949 | Morrone | 242/403.1 |
| 2,601,960 | A | * | 7/1952 | Hick | 242/129.6 |
| 3,009,667 | A | | 11/1961 | Browne | |
| 3,100,607 | A | | 8/1963 | Wiggins | |
| 3,341,149 | A | | 9/1967 | Graham | |
| 3,680,807 | A | | 8/1972 | Fortson | |
| 3,820,733 | A | | 6/1974 | Roederer | |
| 3,967,793 | A | | 7/1976 | Walker | |
| 4,137,939 | A | * | 2/1979 | Chow | 242/403.1 |
| 4,391,422 | A | * | 7/1983 | McDonald | 242/129.6 |
| 4,533,091 | A | * | 8/1985 | Knight | 242/129.6 |
| D328,378 | S | | 7/1992 | Hargrove | |
| 5,333,808 | A | | 8/1994 | Klumpjan | |
| D424,774 | S | | 5/2000 | Zarley | |
| 6,079,663 | A | | 6/2000 | Slater | |

FOREIGN PATENT DOCUMENTS

| | | | | |
|---|---|---|---|---|
| GB | 2 152 900 A | * | 8/1985 | 242/129 |

* cited by examiner

*Primary Examiner*—John M. Jillions

(57) ABSTRACT

The invention relates to a simple, economical, and light-weight device for holding, carrying, and unreeling spools of wire when stringing barbed wire fences. The device includes a pair of leg members bent at a lower end thereof to form feet members for supporting the device on a surface, a swivel arm for holding the spool of wire for rotation thereon during unreeling, and an arm member for carrying or transporting the spool of wire. The spool of wire on the device can be held away from the body of the user while avoiding the dangers encountered with the installation and use of barbed wire.

2 Claims, 4 Drawing Sheets

BARBED WIRE HOLDER, CARRIER, AND UNREELER

CROSS-REFERENCE TO RELATED APPLICATIONS

The inventor of the present application, George C. Jackson, has previously filed the present invention with the United States Patent and Trademark Office as a Provisional Patent, having application No. 60/237,485 dated Oct. 4, 2000.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

Nine patents for improvements to wire fencing were granted by the U.S. Patent Office to American inventors, beginning with Michael Kelly in November 1868 and ending with Joseph Glidden Nov. 24, 1874, U.S. Pat. No. 157,124 for barbed wire. Barbed wire not only simplified the work of the rancher and farmer, but it significantly affected political social, and economic practices.

Since the invention of barbed wire, there has been a need for an apparatus to handle the unrolling of the wire; as can be seen by the following references to U.S. patents. Wire unreeling devices of the general type described below are well known in the art. When laying a string of wire from a spool, such as barbed wire for a fence line, the ground surface, which must be traversed, is often rough and uneven and the barbed wire itself is often difficult to handle because of its inherently hazardous nature and tendency to uncoil or backlash. Prior art devices, which are intended to overcome the foregoing difficulties, tend to become mechanically complex and somewhat unwieldy and difficult to manipulate.

There are numerous dispensers designed to aid in uncoiling and unrolling spooled and rolled materials. Typical of these is U.S. Pat. No. 6,079,663 (242/588.2) issued to Slater on Jun. 24, 2000, U.S. Pat. No. Des. 424,774 (D34/26) issued to Zarley on May 9, 2000 as well as U.S. Pat. No. 5,333,808 (242/598.3) issued to Klumpjan on Aug. 2, 1994.

Other typical patents are:

U.S. Pat. No. Des. 328,378 (D34/24) issued to Hargrove on Jul. 28, 1992.

U.S. Pat. No. 3,967,793 (242/96) issued to Walker on Jul. 6, 1976.

U.S. Pat. No. 3,820,733 (242/94) issued to Roederer on Jun. 28, 1974.

U.S. Pat. No. 3,680,807 (242/94) issued to Fortson on Aug. 01, 1972.

U.S. Pat. No. 3,341,149 (242/94) issued to Graham on Sep. 12, 1967.

U.S. Pat. No. 3,100,607 (242/86.64) issued to Wiggins on Aug. 13, 1963.

U.S. Pat. No. 3,009,667 (242/94) issued to Browne on Nov. 21, 1961.

U.S. Pat. No. 2,140,676 (242/94) issued to Hohner on Dec. 20, 1938.

U.S. Pat. No. 2,089,335 (140/92.2) issued to Brown on Aug. 10, 1937.

U.S. Pat. No. 2,067,765 (242/96) issued to Juranic on Jan. 12, 1937.

U.S. Pat. No. 2,029,953 (242/90) issued to Sutilef on Feb. 04, 1936.

U.S. Pat. No. 1,648,568 (242/391.1) issued to Stoffel on Nov. 08, 1927.

U.S. Pat. No. 1,341,484 (242/588.2) issued to Starratt on May 25, 1920.

U.S. Pat. No. 1,249,691 (242/588.2) issued to Tillman on Dec. 11, 1917.

U.S. Pat. No. 594,977 (242/391) issued to Williams on Dec. 07, 1897.

U.S. Pat. No. 589,490 (242/391) issued to Young on Sep. 07, 1897.

U.S. Pat. No. 467,499 (242/396.8) issued to Dulin on Jan. 26, 1892.

U.S. Pat. No. 6,079,663 Inventor: John E. Slater Issued: Jun. 24, 2000: a spooled barbwire dispenser discloses a swivel hook means for grasping a spool of wire being 360 degrees rotatable centrally mounted onto the underside of a rectangular shaped metal plate whereby the plate further has a handle for being grasped by the user with the handle being welded onto the top of the plate. This invention allows the swivel hook to be hooked onto the handle of a reel of wire such as barbed wire, and further allows the reel of wire to be unrolled so that the wire spool is maintained effectively in the horizontal plane as the spool is transported from one work location to the next.

U.S. Pat. No. Des. 424,774 issued to Zarley on May 9, 2000 is an ornamental design for a portable wire dispensing reel for barbed wire with wheels and a tongue for mechanical pulling.

U.S. Pat. No. 5,333,808 issued to Klumpjan on Aug. 2, 1994 is a wire unreeling device supporting a spool of wire in one position to utilize the rims of the spool as wheels and in an inverted position to hold the spool above the ground in a freewheeling manner.

U.S. Pat. No. Des. 328,378 issued to Hargrove on Jul. 28, 1992 is an ornamental design for a hand pull barbed wire dispenser mounted on wheels with an attached tongue for manual pulling.

U.S. Pat. No. 3,967,793 Inventor: David O. Walker Issued: Jul. 6, 1976 is a wire spool holder, specifically adapted for barbed wire and the like, includes freely rotatable spool engaging members and a freely rotatable holding or grasping member connected to the engaging members.

U.S. Pat. No. 3,820,733 issued to Roederer on Jun. 28, 1974 relates to maneuvering and handling devices and carriers for dual headed reels such as are employed for storing and dispensing barbed wire and has to do with a novelly constructed sectional or knockdown reel and an elongated supporting or handling frame which functions to mount the reel for roll-along use or, alternatively, for supported use on a farming machine.

U.S. Pat No. 3,680,807 issued to Fortson on Aug. 01, 1972—a roller assembly for rolling over the ground either by hand or by being pulled by a powered vehicle and includes opposite end large diameter wheel portions and a diametrically reduced center portion rotatable with the wheel portions and upon which a spool of wire is disposed for rotation with and unwinding from the reduced center portion of the roller assembly.

U.S. Pat. No. 3,341,149 issued to Graham on Sep. 12, 1967 is characterized by an elongated sled-like frame, which can be converted from a sled to a roll-along vehicle by attaching wheels to brackets provided for on the sled. The frame can be dragged along behind a tractor on the wheels or removing the wheels and using the frame as a push-pull type sled.

U.S. Pat. No. 3,100,607 issued to Wiggins on Aug. 13, 1963 discloses a barbed wire reel holder including a pair of wheels each having an opening there through, a continuous axle extending through the opening in each of the wheels for placing varying widths of rolls of wire.

U.S. Pat. No. 3,009,667 issued to Browne on Nov. 21, 1961 discloses a device for aiding in the unreeling of wire on a spool comprising a generally u-shaped frame having an elongated handle extending from the u-shaped frame, a transverse hollow member at the free end of the handle forming hand grips and a pair of removable circular wheels fixedly attached to the axle.

U.S. Pat. No. 2,140,676 issued to Hohner on Dec. 20, 1938 is a wire-handling device comprising a substantially u-shaped frame, including a handle and parallel legs on the handle, a transverse axle having one end connected to the free end of one of the legs adapted for insertion through a spool of wire.

U.S. Pat. No. 2,089,335 Inventor: G. L. Brown Issued: Aug. 10, 1937—this United States Patent discloses a method for spooling barbed wire wherein all of the barbs project inwardly and for carrying purposes there is provided a stirrup or carrying frame the cross piece between the two arms serving as a handle.

U.S. Pat. No. 2,067,765 Inventor: Walter Juranic Issued; Jan. 12, 1937—this United States Patent discloses a reel holding device which has the reel of material rotatable suspended so as to facilitate the discharge or unreeling of the material and when the device is not in use it may be collapsed to a compact form to occupy a minimum of space in storage.

U.S. Pat. No. 2,029,953 issued to Sutilef on Feb. 04, 1936 discloses a wire carrying reel comprising a hauling frame comprising a rod or tube which is bent into a u-shape producing a pair of shafts for pulling or pushing the implement using the wheels mounted in the rear end of the frame.

U.S. Pat. No. 1,648,568 issued to Stoffel on Nov. 08, 1927 relates to a winch structure upon which a spool containing barbed wire may be mounted and the rotation of the spool by rolling the structure along the ground will cause the barbed wire to be fed off the spool.

U.S. Pat. No. 1,341,484 Inventor: Harold E. Starratt Issued: May 25, 1920—this United States Patent discloses a single piece of resilient metal bent to form a grip member, a handle member having two straight portions adapted to lie parallel to each other, a pair of oppositely extending arms at the end of said handle portion, jaw members adjustably mounted on the ends of said arms, bearing members carried by said jaws members, means for securing the jaw members in their adjusted positions on the arms, and a keeper adapted to engage the portions of the handle member to draw the bearing members into a predetermined relation to each other.

U.S. Pat. No. 1,249,691 issued to Tillman on Dec. 11, 1917 is a reel for supporting barbed wire during the application of the wire to a fence; providing a reel, which may be readily carried by two workmen.

U.S. Pat. No. 594,977 issued to Williams on Dec. 07, 1897 is a wire unwinding device consisting of a u-shaped bail having one end terminated in the form of an eye, a side bar having one end adapted to loosely engage the eye, and the other end arranged to engage the opposite end of said bail.

U.S. Pat. No. 589,490 issued to Young on Sep. 07, 1897 discloses a device for distributing fence wire, two side bars having handles at one end and aligned bearings at opposite end allowing for the distributing of up to three rolls of wire at the same time.

U.S. Pat. No. 467,499 issued to Dulin on Jan. 26, 1892 discloses a fence wire reel and tightener consisting of a reel adapted to fit loosely on an axle with transporting wheels.

While these wire spool dispensers, described by the previously issued patents, may be suitable for the purposes for which they were designed, they would not be as suitable for the purposes of the present invention, as hereinafter described.

BRIEF SUMMARY OF THE INVENTION

A primary object of the present invention is to provide a light weight apparatus, which can be used by one person to hold and carry a spool of wire, specifically barbed wire, and to dispense said wire while moving from one location to another over all types of terrain such as gullies, rocky ground, smooth ground, between and around trees, through vines, leaves, and other debris; while keeping the roll of wire, specifically barbed wire, from coming into contact with the person or any of the above mentioned encumbrances.

Another object of the present invention is to provide a wire holder, carrier, and dispenser or unreeler, specifically a barbed wire holder, carrier, and dispenser or unreeler, having a handgrip or handle, which will allow for easy handling of spools of wire, specifically barbed wire, by one person.

Yet another object of the present invention is to provide a method for holding a spool or reel of wire, and means for engaging a spool or reel of wire, a method for unreeling the spool or reel of wire without the wire, specifically barbed wire, touching the ground which will prevent trash, leaves, vines, and other debris from becoming entangled in the roll of wire.

Still yet another object of the present invention is to provide a means for the device to stand upright when not in use as well as to provide the means for the device to move easily over the ground surface thus eliminating the need for wheels to be attached to the device thereby preventing debris from becoming entangled in same.

Generally, spools of wire are heavy and cumbersome to handle. With respect to barbed wire, the dangers encountered with the installation and uses thereof are well known and self-evident. In manual installations, spools of barbed wire are unwound and erected by, usually, two or more persons. Because of the hazards encountered with the barbs, one person controls and guides the unreeling of the spool while the other person installs the wire. Such two person installations are expensive and time consuming.

The present invention provides a device, particularly adapted for barbed wire, which enables the holding, carrying, unreeling, and installation of barbed wire by one person, while avoiding the problems and dangers encountered with the installation and use of barbed wire.

In accordance with the present invention there is provided a wire spool holder, carrier, and unreeler device particularly adapted for use with spools of barbed wire. The device hereof generally comprises a means for engaging a spool of wire, a means for grasping or holding the spool of wire, a means for carrying or transporting the spool of wire, and a means for unreeling the spool of wire.

The means for engaging the spool allows the spool of wire to rotate freely, permitting the unreeling of the wire from the spool. The means for engaging is connected to the means for grasping such that a spool of wire engaged therewith can be held away from the body of the user, thus avoiding the dangers encountered with the installation and use of barbed wire.

In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention.

For a more complete understanding of the present invention, reference is made to the following detailed description and accompanying drawings.

BRIEF DESCRIPTION OF THE SEVERAL VIEWS OF THE DRAWING

In the accompanying drawings, like reference characters designate the same or similar parts throughout the several views.

In order that the invention may be more fully understood, it will now be described, by way of example with reference to the accompanying drawings in which.

DETAILED DESCRIPTION OF THE INVENTION

Figure 1:
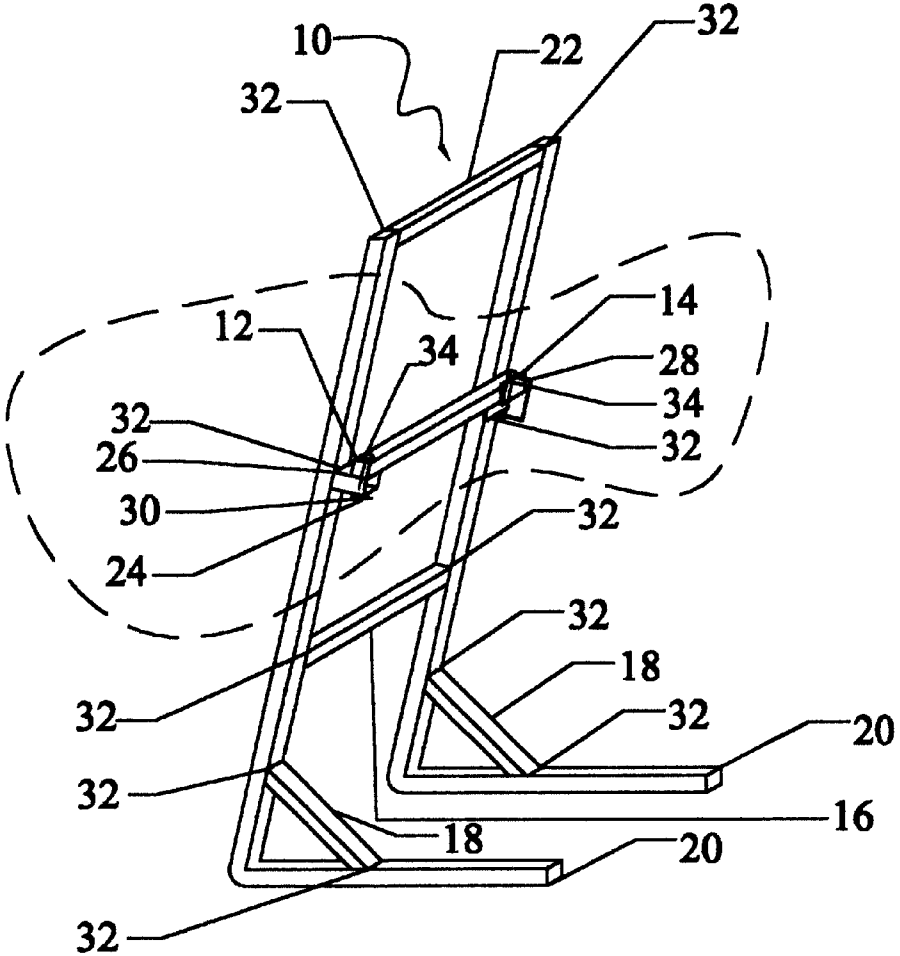
FIG. 1 is a perspective view of the present invention 10.

Turning now descriptively to the drawings, in which similar reference characters denote similar elements throughout the several views, FIG. 1 through FIG. 4 illustrates the present invention 10 being a device for holding, carrying, and unreeling a spool wire, specifically a spool of barbed wire 42. With regard to the reference numerals used, the following numbering is used throughout the various drawings.

10 present invention
12 swivel arm
14 "Z" shelf bracket
16 cross brace
18 support brace(s)
20 leg(s)
22 hand grip
24 swivel lock pin
26 swivel shelf
28 swivel arm latch pin
30 cotter pin
32 welding points
34 7/16 inch hole for inserting swivel arm latch pin 28 and 7/16 inch hole for inserting swivel lock pin 24
40 user
42 reel of barbed wire
44 single strand of barbed wire Turning to FIG. 1, therein is shown a perspective view of the present invention 10, a wire spool holder, carrier, and unreeler. The present invention 10 comprises two sixty-inch pieces of ¾ inch square galvanized steel hollow tubing for the two legs 20; one thirteen-inch piece of ¾ inch square galvanized steel hollow tubing for the swivel arm 12; one eleven-inch piece of ¾ inch square galvanized steel hollow tubing for the hand grip 22; one eleven-inch piece of ¾ inch square galvanized steel hollow tubing for the cross brace 16; two nine-inch pieces of ¾ inch square galvanized steel hollow tubing for the two support braces 18; one two-inch "Z" shelf bracket 14; one three-inch piece of ¾ inch square galvanized steel hollow tubing for the swivel shelf 26; one three-inch latch pin (swivel arm latch pin) 28; one two-inch swivel lock pin 24; and one one-inch cotter pin 30.

Each of the two sixty-inch pieces of ¾ inch square galvanized steel hollow tubing is bent seventeen-inches from one end, creating a seventy-five degree angle, to form feet extending at an acute angle from the rest of the legs 20 to support the apparatus on a surface. The two legs 20 are held upright by the bending of the two sixty-inch pieces of galvanized steel hollow tubing to create the seventy-five degree angles on each of the two sixty-inch pieces of galvanized steel hollow tubing. The two legs 20 are held together by an eleven-inch cross brace 16, which is welded to each of the two legs 20, twenty-six inches from the top as denoted by welding point 32 on each of the two legs 20. The eleven-inch hand grip 22 is attached to the top of each of the two legs 20 by welding as denoted by welding points 32 on each of the two legs 20. Welding a nine-inch support brace 18 onto each of the two legs 20 as denoted by welding points 32 further braces the present invention 10.

The wire spool holder mechanism is created by welding the three-inch piece of ¾ inch square galvanized steel hollow tubing fourteen inches from the top of the right leg 20 forming the swivel shelf 26 as shown by welding point 32; and by welding the two-inch "Z" shelf bracket 14 fourteen inches from the top onto the left leg 20 as shown by welding point 32. The means for engaging a reel or spool of wire in the present invention 10 is referred to as the swivel arm 12. The swivel arm 12 is created by cutting the ¾ inch square galvanized steel hollow tubing thirteen-inches in length. Place the ¾ inch square galvanized steel hollow tubing which has been cut into a thirteen-inch length (swivel arm 12) onto the top of the swivel shelf 26 and onto the top of the two-inch "Z" shelf bracket 14. Drill a 7/16 inch diameter hole 34 (¼ inch from the end) into the left end of the swivel arm 12 and through the swivel shelf 26; also drill a 7/16 inch diameter hole 34 (¼ inch from the end) into the right end of the swivel arm 12 and through the two-inch "Z" shelf bracket 14. The swivel arm 12 is then attached to the present invention 10 by placing the swivel arm 12 onto the swivel shelf 26, then inserting the two-inch swivel lock pin 24 into the left 7/16 inch hole 34 on the swivel arm 12 and through the swivel shelf 26, and finally inserting a one-inch cotter pin 30 into the two-inch swivel lock pin 24. The swivel arm 12 is locked in place by placing the swivel arm 12 onto the "Z" shelf bracket 14, inserting the three-inch swivel arm latch pin 28 into the 7/16-inch diameter hole 34 on the swivel arm 12 and through the 7/16-inch diameter hole 34 previously drilled in the "Z" shelf bracket 14.

Figure 2:
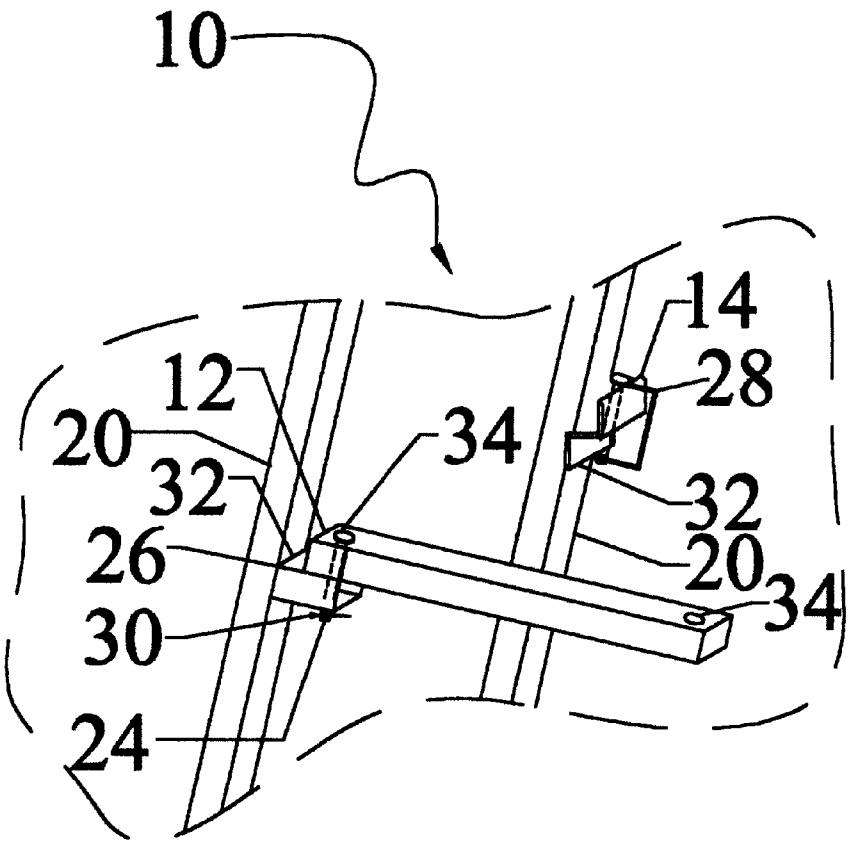
FIG. 2 is an enlarged view of the present invention 10, taken from FIG. 1 as indicated, showing the present invention 10 with the swivel arm 12 extended.

Referring to FIG. 2, which is an enlarged view of the present invention 10, taken from FIG. 1 as indicated showing the present invention 10 with the swivel arm 12 extended.

Figure 3:
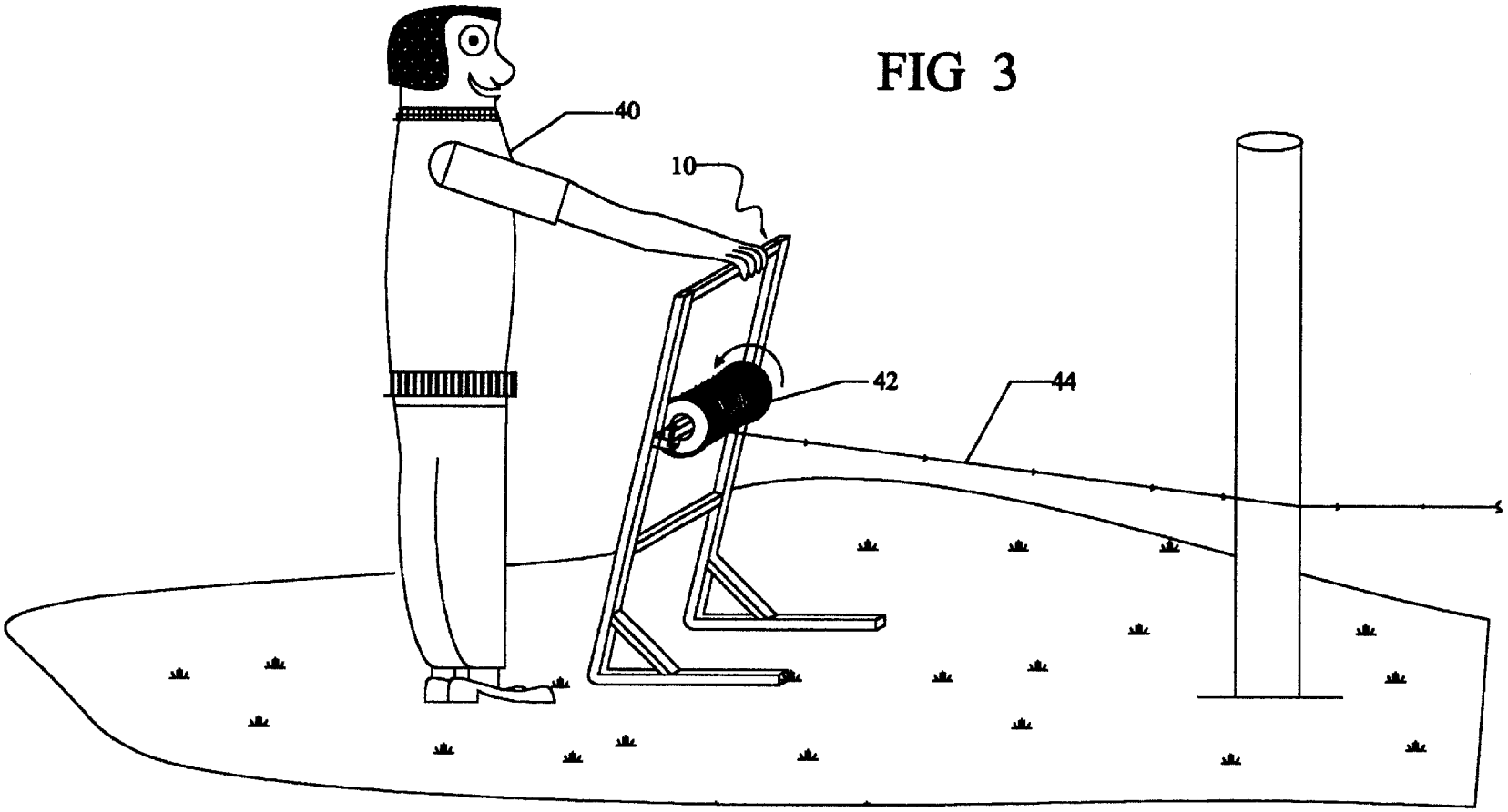
FIG. 3 is a perspective view of the present invention 10 in use. Shown is the present invention 10 with a spool of barbed wire 42 on the swivel arm wherein the spool of barbed wire 42 has rotated freely after the strand of barbed wire 44 has been attached to the post, and is in a stationary position for the next course of action by the user 40.

In utilizing the present device 10, and as depicted in FIG. 3, the spool engaging means referred to as the swivel arm 12 embraces a spool or reel of barbed wire 42 (or similar spool of wire). The user 40 then grasps the hand grip 22. To unwind the reel of barbed wire 42 (or similar spool of wire), the present invention 10 has been pulled forward and away from the post or structure, which the single strand of barbed wire 44 has been attached to. The single strand of barbed wire 44 is unreeled in the direction of the arrow as shown on FIG. 3.

Figure 4:
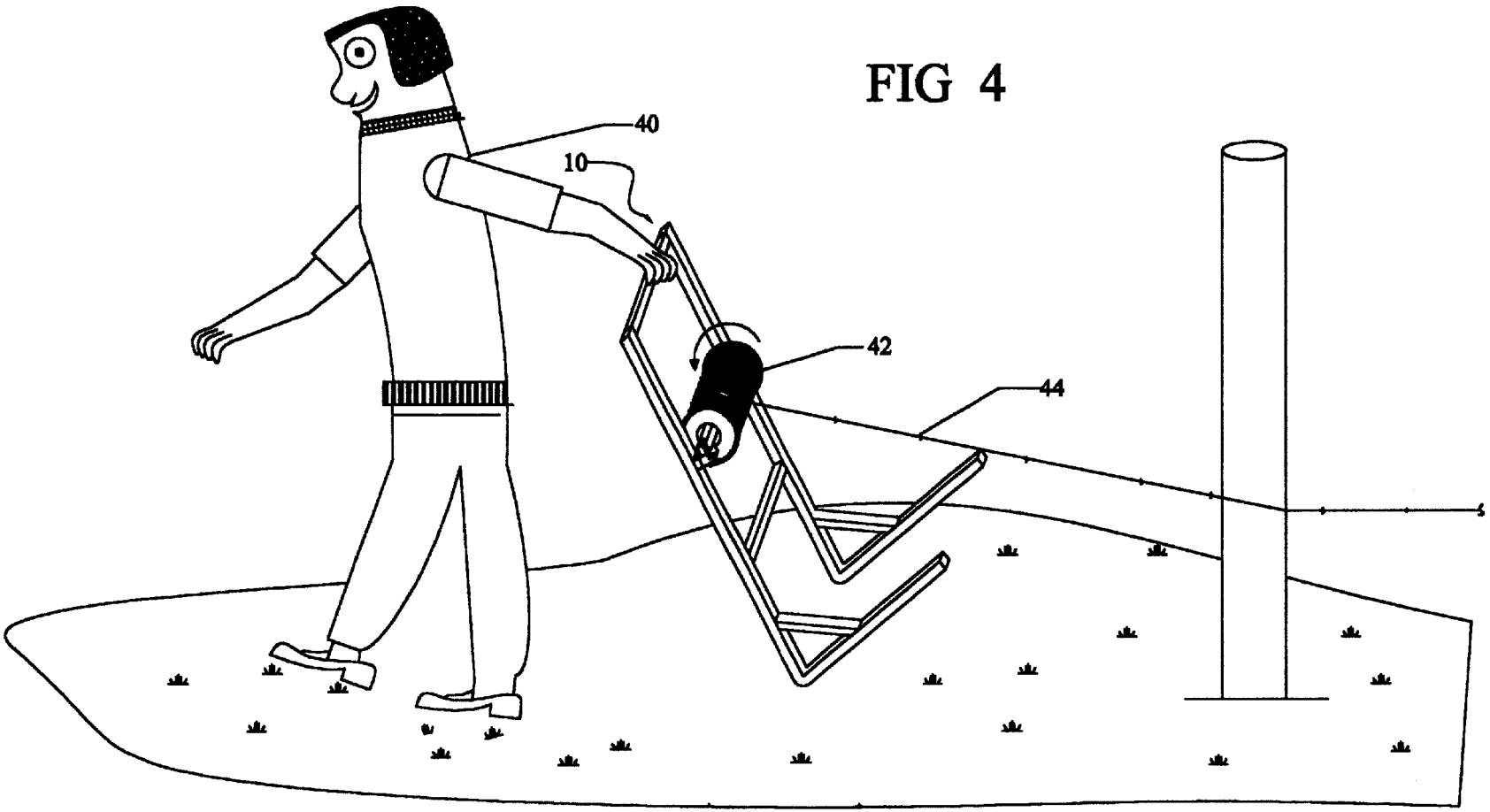
FIG. 4 is a perspective view of the present invention 10 in use. Shown is the present invention 10 with a spool of barbed wire 42 on the swivel arm wherein the spool of barbed wire 42 is rotating freely after the strand of barbed wire 44 has been attached to the post as the user 40 moves the device from one location to another. This perspective view of the present invention in use clearly shows that the spool of barbed wire 42 is off the ground surface sufficiently to prevent debris from becoming entangled in the spool of barbed wire 42, as well as showing the user 40 is a safe distance from the spool of barbed wire 42, thereby decreasing the possibilities for bodily injury to the user.

FIG. 4 is another representation of the present invention 10, the spool engaging means referred to as the swivel arm 12 embraces a spool or reel of barbed wire 42 (or similar spool of wire). As the user 40 grasps the hand grip 22 of the present invention 10 (barbed wire holder, carrier, and unreeler); the present invention 10 tilts forward as the device is pulled forward and away from the post or structure to which the single strand of barbed wire 44 has been attached. This action results in the reel of barbed wire 42 (or similar spool of wire) being unreeled. The single strand of barbed wire 44 is unreeled in the direction of the arrow as shown on FIG. 4.

The present invention 10 can be laid face-down and with the swivel arm 12 extended, the swivel arm 12 can be inserted into the roll of wire without the user ever touching the roll of wire; thus eliminating one of the dangers associated and encountered when working with wire such as barbed wire. After the roll of wire has been inserted onto the swivel arm 12; the swivel arm 12 is locked in place by placing the swivel arm 12 onto the "Z" shelf bracket 14 and inserting the three-inch swivel arm latch pin 28 into the 7/16-inch diameter hole 34 in the swivel arm 12 and through the 7/16-inch diameter hole 34 in the "Z" shelf bracket 14, then locking the three-inch swivel arm latch pin 28 in place. The present invention 10 can then be raised into an upright position by using the hand grip 22. The present invention 10 will stand upright and ready for use.

It is apparent from the preceding that one individual can handle a spool of wire, and particularly barbed wire, without encountering the dangers associated with such wire. The means for holding, carrying, and unreeling permits the user to maintain a safe distance from the barbs while still allowing the wire to be unreeled from the spool.

Having thus described my invention, what I claim specifically is:

1. An apparatus for holding, carrying, and unreeling rolls of wire comprising:

two straight parallel leg members connected together at one of their ends by an elongated hand grip member, said hand grip member forming a carrying handle for the apparatus;

a cross brace connected between the leg members between the ends thereof, said leg members being bent at an acute angle thereto near the other ends of the leg members to form a pair of straight feet members for supporting the apparatus on a surface;

a shelf member connected to one of the leg members between the ends thereof and a bracket member connected to the other of the leg members;

a swivel arm pivotally connected at one end thereof to the shelf member and a latch pin removably connected to the bracket member and the other end of the swivel arm;

whereby the swivel arm may be swiveled away from the leg members to load a roll of wire onto the swivel arm and the swivel arm locked by the latch pin to the bracket member to support the roll of wire for rotation.

2. The apparatus of claim 1 further comprising support braces connected between each of the leg members and corresponding feet members.

* * * * *